US011060684B2

(12) United States Patent
Moser

(10) Patent No.: US 11,060,684 B2
(45) Date of Patent: Jul. 13, 2021

(54) MOTOR VEHICLE ILLUMINATION DEVICE COMPRISING MICRO-OPTICAL SYSTEMS PROVIDED WITH SUB-DIVIDED INCIDENCE MICRO-OPTICAL ELEMENTS

(71) Applicant: ZKW GROUP GMBH, Wieselburg (AT)

(72) Inventor: Andreas Moser, Perg (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 16/648,552

(22) PCT Filed: Jul. 30, 2018

(86) PCT No.: PCT/AT2018/060169
§ 371 (c)(1),
(2) Date: Mar. 18, 2020

(87) PCT Pub. No.: WO2019/060935
PCT Pub. Date: Apr. 4, 2019

(65) Prior Publication Data

US 2020/0217471 A1 Jul. 9, 2020

(30) Foreign Application Priority Data

Sep. 27, 2017 (AT) ..... A 50826/2017

(51) Int. Cl.
*F21S 41/265* (2018.01)

(52) U.S. Cl.
CPC ..... *F21S 41/265* (2018.01)

(58) Field of Classification Search
CPC ..... F21S 41/265; F21S 41/43; F21S 41/285; F21S 41/143; F21S 41/275; G02B 3/0062; G02B 27/0961
See application file for complete search history.

(56) References Cited

U.S. PATENT DOCUMENTS 4,859,043 A 8/1989 Carel et al.
2015/0252975 A1 9/2015 Nakada
(Continued)

FOREIGN PATENT DOCUMENTS

EP 0738903 A1 10/1996
EP 2110689 A1 10/2009
WO 2011/027254 A1 3/2011

OTHER PUBLICATIONS

Search Report for Austrian Patent Application No. 50826/2017, dated May 4, 2018 (1 page).
International Preliminary Report on Patentability for PCT/AT2018/060169, dated Nov. 14, 2018 (4 pages).

*Primary Examiner* — Donald L Raleigh
(74) *Attorney, Agent, or Firm* — Eversheds Sutherland (US) LLP

(57) ABSTRACT

The invention relates to a motor vehicle illumination device (1) for generating light distribution, comprising an optical imaging system (2) and at least one light source (3) associated with the optical imaging system, in which: the optical imaging system (2) comprises a collimator (4), an incidence optical element (5) and an emergence optical element (6); the collimator (4) is arranged between the at least one light source (3) and the incidence optical element (5) and is designed to collimate light beams produced by the at least one light source (3) in order to produce collimated light beams, and to guide the collimated light beams (7) towards the incidence optical element (5) of the optical imaging system (2); the incidence optical element (5) comprises a plurality of integrally formed incidence micro-optical elements (50 to 58), a first optical axis (50*a* to 58*a*) being associated with each incidence micro-optical element (50 to 58) and all first optical axes (50*a* to 58*a*) extending in the same direction corresponding to the direction of propagation of the collimated light beams (7); the emergence optical
(Continued)

element (6) comprises a plurality of integrally formed emergence micro-optical elements (60), a second optical axis (60*a*) being associated with each emergence micro-optical element (60) and all second optical axes (60*a*) extending in the same direction; each incidence micro-optical element (50-58) comprises a light incidence surface (50*b* to 58*b*) facing the collimated light beams and a light emergence surface (50*c* to 58*c*) facing the emergence optical element (6), all of the light emergence surfaces (50*c* to 58*c*) forming a common, preferably flat surface (8); and at least two differently formed incidence micro-optical elements (50 to 58) are associated with each emergence micro-optical element (60) in such a way that light beams (9*a* to 9*c*) hitting the at least two differently formed incidence micro-optical elements (50 to 58) and passing through said at least two differently formed incidence micro-optical elements (50 to 58) exclusively hit the emergence micro-optical element (60) associated with the at least two differently formed incidence micro-optical elements (50 to 58) and form different sub-regions of the light distribution after having passed though the emergence micro-optical system (60).

11 Claims, 6 Drawing Sheets

(56) References Cited

U.S. PATENT DOCUMENTS

| | | | | |
|---|---|---|---|---|
| 2016/0265733 | A1* | 9/2016 | Bauer | F21S 41/635 |
| 2017/0241606 | A1 | 8/2017 | Courcier | |
| 2018/0199017 | A1 | 7/2018 | Michaelis et al. | |
| 2018/0320852 | A1 | 11/2018 | Mandl | |
| 2019/0072252 | A1 | 3/2019 | Moser et al. | |

* cited by examiner

MOTOR VEHICLE ILLUMINATION DEVICE COMPRISING MICRO-OPTICAL SYSTEMS PROVIDED WITH SUB-DIVIDED INCIDENCE MICRO-OPTICAL ELEMENTS

The invention relates to a motor-vehicle illumination device for generating a light distribution, comprising an optical imaging system and at least one light source assigned to the optical imaging system, wherein the optical imaging system comprises a collimator, an incidence optical element and an emergence optical element, wherein the collimator is arranged between the at least one light source and the incidence optical element and is set up to collimate light beams generated by the at least one light source, in order to generate collimated light beams in this manner and to direct the collimated light beams onto the incidence optical element of the optical imaging system, wherein the incidence optical element has a plurality of micro-incidence optical elements constructed integrally with one another, wherein a first optical axis is assigned to each micro-incidence optical element, wherein all first optical axes run in the same direction, preferably parallel to one another, which direction corresponds to the propagation direction of the collimated light beams, wherein the emergence optical element has a plurality of micro-emergence optical elements constructed integrally with one another, wherein a second optical axis is assigned to each micro-emergence optical element, wherein all second optical axes run in the same direction, preferably parallel to one another, wherein each micro-incidence optical element has a light incidence surface facing the collimated light beams and a preferably plane light emergence surface facing the emergence optical element, wherein all light emergence surfaces form a common, preferably plane surface.

The above-mentioned type of motor-vehicle illumination devices is known from the prior art. AT 514967 B1 of the applicant describes a projection light module for a motor-vehicle headlamp, which may comprise an incidence optical element, an emergence optical element and a screen device. In this case, both the incidence optical element and the emergence optical element are constructed as micro-optical arrays. In this case, a micro-incidence optical element, a micro-emergence optical element and possibly a screen arranged between these two optical elements form an optical imaging system, using which a part of the common light distribution is generated. In this case, a partial intermediate image imaged as this part of the light distribution in front of the motor-vehicle illumination device is generated by the corresponding individual micro-incidence optical element. This is disadvantageous insofar as only the degrees of freedom of the, in each case, one micro-incidence optical element can be used in order to configure the light distribution.

The object of the present invention consists in developing the motor-vehicle illumination device of the above-mentioned type in such a manner that the number of possibilities for modifying and/or setting and/or finely adjusting the radiated light distribution is increased.

This object is achieved according to the invention by means of a motor-vehicle illumination device of the above-mentioned type, in that at least two differently constructed micro-incidence optical elements are assigned to each micro-emergence optical element in such a manner that light beams incident onto the at least two differently constructed micro-incidence optical elements and passing through these at least two differently constructed micro-incidence optical elements are incident onto the micro-emergence optical element assigned to the at least two differently constructed micro-incidence optical elements and form different part regions of the light distribution after passage through the micro-emergence optical element.

For example, one can use the construction and/or the shape of the individual micro-incidence optical elements in order to effect certain desired changes of the radiated light distribution.

Furthermore, it may be expedient if the at least two micro-incidence optical elements are constructed as an N×M micro-incidence-optical-element array, where N≥2 or M≥2, preferably as a 3×3 micro-incidence-optical-element array, or arranged in an N×M micro-incidence-optical-element array, where N≥2 or M≥2, preferably in a 3×3 micro-incidence-optical-element array.

In addition, it may be advantageous if the incidence optical element is set up to generate an intermediate image (with the aid of at least two differently constructed micro-incidence optical elements), which intermediate image is imaged by the emergence optical element in front of the motor-vehicle illumination device, wherein the intermediate image is preferably located in front of the emergence optical element.

It may be advantageous if all micro-incidence optical elements are constructed as lenses. Compared to conventional lenses, these lenses have a smaller diameter and consequently also a smaller central thickness. This may be advantageous with regards to the production of the lenses. Furthermore, a reduction of the thickness of the entire incidence optical element results. This allows a lower longitudinal extent of the incidence optical element and, as a consequence, the entire optical imaging system and therefore brings advantages in terms of installation. Furthermore, lenses with a small central thickness have a smaller wall-thickness variation. This means that manufacturing tolerances can be kept low.

It may furthermore be advantageous if at least one first micro-incidence optical element of the at least two differently constructed micro-incidence optical elements assigned and/or corresponding to the micro-emergence optical element is constructed in such a manner and corresponds and/or is assigned to the micro-emergence optical element in such a manner that collimated light beams incident onto this at least one first micro-incidence optical element propagate in the direction of an HV region of the light distribution after emergence from the micro-emergence optical element. The at least one first micro-incidence optical element may for example be constructed as a plano-convex lens.

If the micro-incidence optical elements are constructed as lenses, for example as free-form lenses, and corresponds and/or is assigned to each micro-emergence optical element, for example a 3×3 micro-incidence-optical-element array, then for example a central lens of the array may focus more strongly than its neighbours, in order to achieve a higher maximum of the illuminance at the HV point. In this case, the term "HV region" is understood to mean a region around the HV point, which is extended from −5° to +5° horizontally and from −5° to +5° vertically. Preferably, the vertical extension of the HV region is from −2° to +2°, if the motor-vehicle illumination device is used for realizing a driving-light function (for example generating a dipped-beam or main-beam distribution), and from −5° to +5°, if the motor-vehicle illumination device is used for realizing a signal-light distribution (for example generating an indicator-light distribution).

In addition, it may be expedient if at least one second micro-incidence optical element of the at least two differently constructed micro-incidence optical elements assigned and/or corresponding to the micro-emergence optical element is constructed in such a manner and corresponds and/or is assigned to the micro-emergence optical element in such a manner that collimated light beams incident onto this at least one second micro-incidence optical element propagate in the direction outside of an HV region of the light distribution after emergence from the micro-emergence optical element. The at least one second micro-incidence optical element may for example be constructed as a plano-concave lens or as a plano-concave lenspiece or as a plano-convex lenspiece. In this case, it is also true, that if the micro-incidence optical elements are constructed as lenses, for example as free-form lenses, and for example a 3×3 micro-incidence-optical-element array corresponds and/or assigned to each micro-emergence optical element, then the lenses adjoining the central lens of the array and surrounding this central lens may for example focus more weakly than the central lens, in order to determine the width of the light distribution or edges of the light distribution in this manner.

In addition, it may be expedient if the light incidence surfaces of the micro-incidence optical elements are constructed as free-form surfaces. In this case, a free-form surface is understood to mean a surface, which is typical for a free-form lens. For example, the light incidence surface of the at least one first micro-incidence optical element of the at least two micro-incidence optical elements may be curved differently in the horizontal and in the vertical direction. The light incidence surface of the at least one second micro-incidence optical element of the at least two micro-incidence optical elements may likewise be constructed as a free-form surface. It may furthermore be expedient if the courses of the free-form surfaces of the light incidence surfaces of the at least one first and at least one second micro-incidence optical elements mentioned are different (cf. FIGS. 5 to 8 in particular).

The light incidence surfaces of the micro-incidence optical elements and the light emergence surfaces of the micro-emergence optical elements may be curved differently. In this case, in a micro-optical system, which for example comprises a micro-emergence optical element, the at least two micro-incidence optical elements assigned to the micro-emergence optical element and optionally a screen, each micro-incidence optical element may have its own curvature of the light incidence surface, which curvature may also differ from the curvature of the light emergence surface of the micro-emergence optical element. This allows the parameters, such as for example focal length, strength of the collimation of a light beam passing through, etc., of each individual micro-optical system to vary independently of the parameters of the other micro-optical systems. These parameters are often mentioned in the technical literature as "Degrees of freedom of the optical system".

In connection with the present invention, the term "vertical"/"horizontal" is understood to mean an axis of a coordinate system connected to the motor-vehicle illumination device, which is aligned vertically/horizontally if the motor-vehicle illumination device is in a position, which position corresponds to an installation state of the motor-vehicle illumination device in a motor vehicle.

The invention is explained in more detail in the following on the basis of exemplary non-limiting embodiments, which are shown in a drawing. In the figures.

Figure 1:
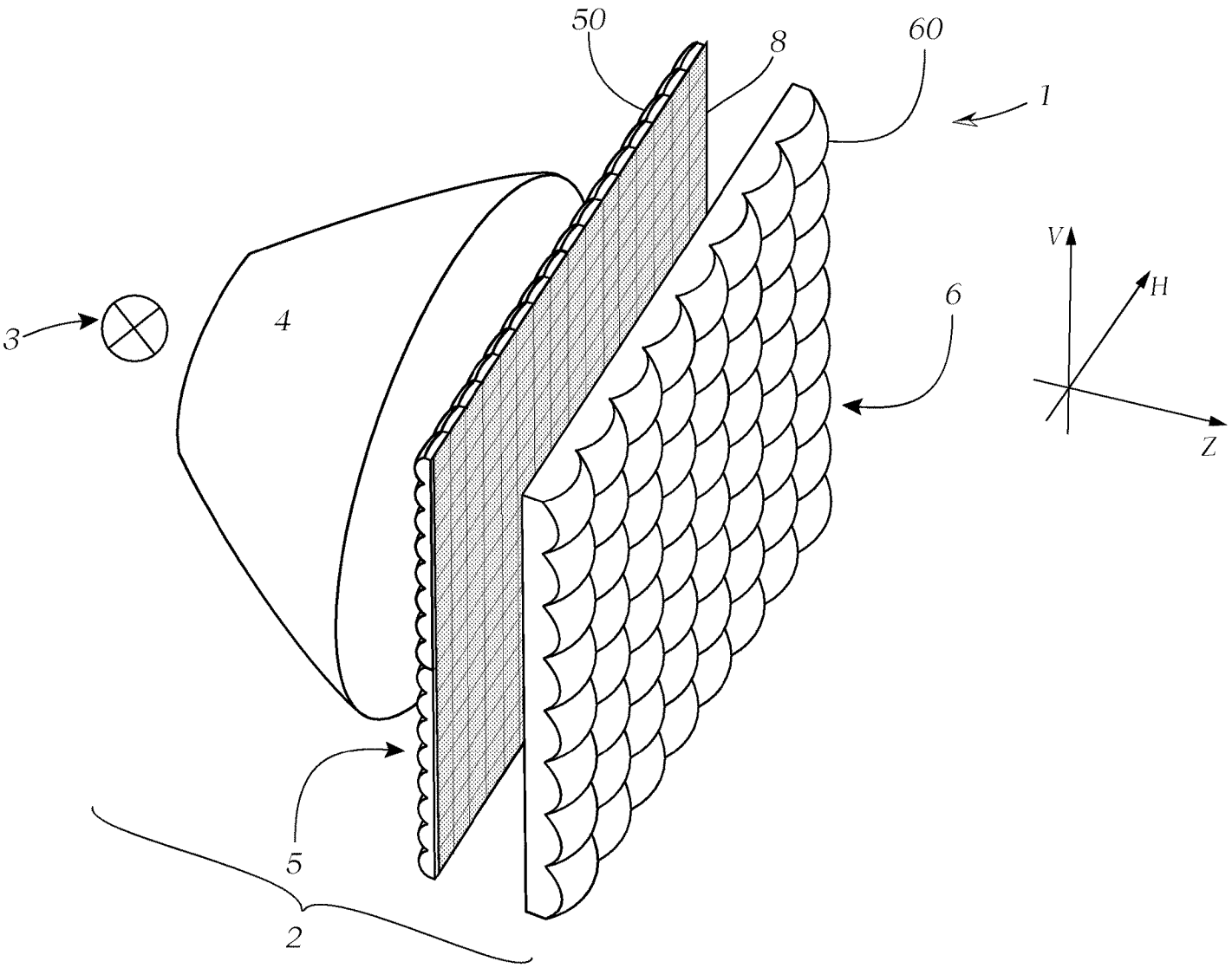
FIG. 1 shows a lighting module in an exploded illustration.

First, reference is made to FIG. 1. This shows a lighting module 1, which may correspond to a motor-vehicle illumination device according to the invention. A lighting module of this type may for example be used in a front headlamp of a motor vehicle and set up for generating a, for example lawful light distribution. The legal requirements and standards may be different in this case for different countries and/or regions of the world. In this case, the lighting module according to the invention may simultaneously fulfil the requirements in a plurality of countries/regions (e.g. EU, North America, Japan and China). The lighting module comprises an optical imaging system 2 and at least one light source 3 assigned to the optical imaging system. The optical imaging system has a collimator 4—which is set up to collimate light beams generated by the at least one light source 3—an incidence optical element 5 and an emergence optical element 6. The collimator is usually arranged between the at least one light source 3 and the incidence optical element 5. The collimator 4 may for example be constructed as a TIR lens (TIR for Total Internal Reflection). Furthermore, a collimator may be constructed as an optical body constructed from a material, the refractive index of which is greater than the refractive index of air (at conventional operating temperatures of a motor-vehicle headlamp)—such as glass or plastic—which optical body conducts the light almost without losses, owing to the physical effect known under the name "total internal reflection", from its light in-coupling surface to its light out-coupling surface. In this case, essentially the total light refracted at the light out-coupling surface of the optical body continues to propagate through the air, preferably in a predetermined direction (in FIG. 1—direction Z). It is also conceivable that the collimator 4 is constructed as a reflector, i.e. as a (primarily visible) light reflective surface, which deflects light beams propagating through air in preferably one predetermined direction (in FIG. 1—direction Z).

The lighting module may also comprise other parts, such as for example heat sinks, supporting frames and/or electrical setting devices, covers and so on. However, for the sake of simplicity, the parts of the lighting module, which may prove useful when illustrating the inventive idea, are shown schematically. In this case, a detailed description of the above-mentioned standard components of a lighting module is dispensed with.

Figure 5:
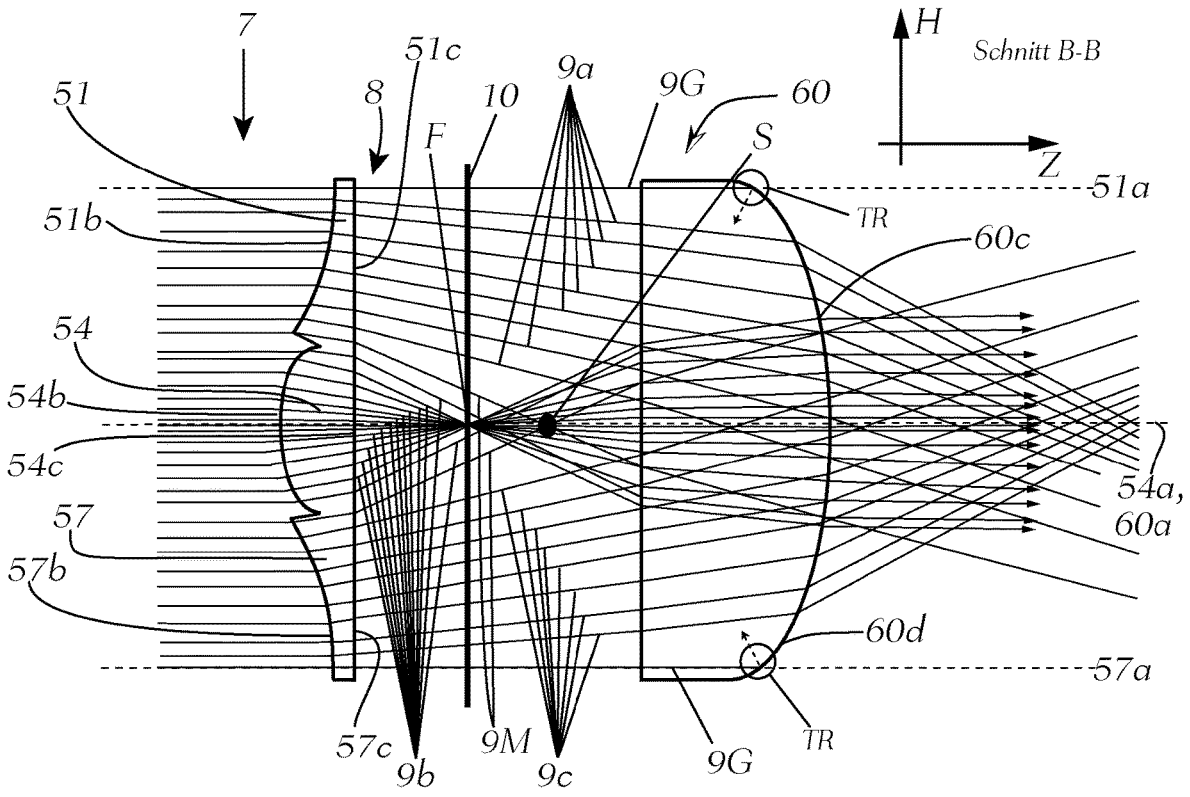
FIG. 5 shows a B-B section of FIG. 3.
Figure 8:
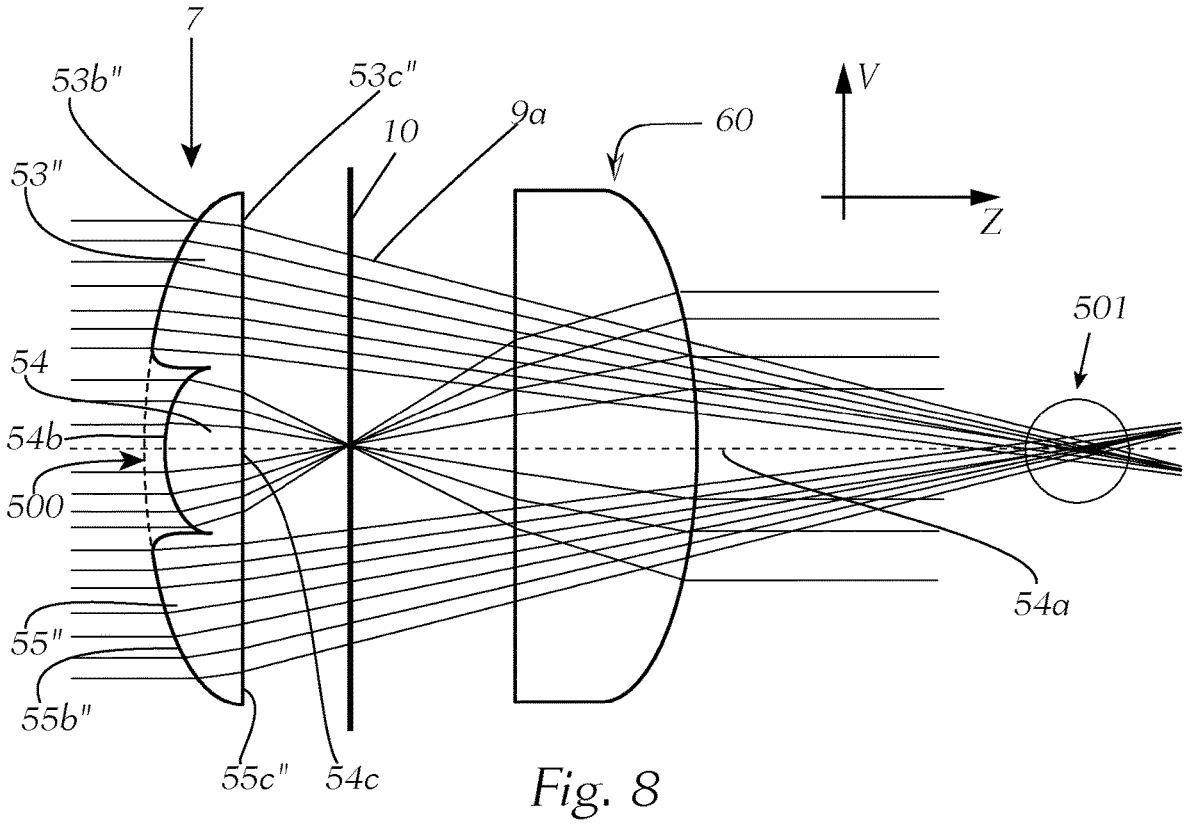
FIG. 8 shows a vertical section of an enlarged cutout of a further embodiment of a lighting module according to the invention.

The light generated by the light source 3, which makes it into the collimator 4, is shaped by the same to form a light bundle, preferably made up of collimated light beams 7, wherein the collimated light beams are aligned substantially parallel to one another (cf. FIGS. 5 and 8 for example). In this case, substantially parallel means that the collimated beams only run parallel if the light source is formed as an ideal punctiform light source. This mathematical abstraction only arises very rarely in the modern automotive industry however. In expanded (non-punctiform) light sources (for example an LED light source), a deviation from the above-mentioned parallelism of the light beams results in the light bundle, depending on the imaging scale.

A deviation of up to +/−15° is possible. An even greater deviation is possible under certain circumstances. The collimated light beams 7 are incident onto the incidence optical element 5 of the optical imaging system 2. The lighting module 1 shown is particularly well suited for generating a main-beam distribution.

Figure 2:
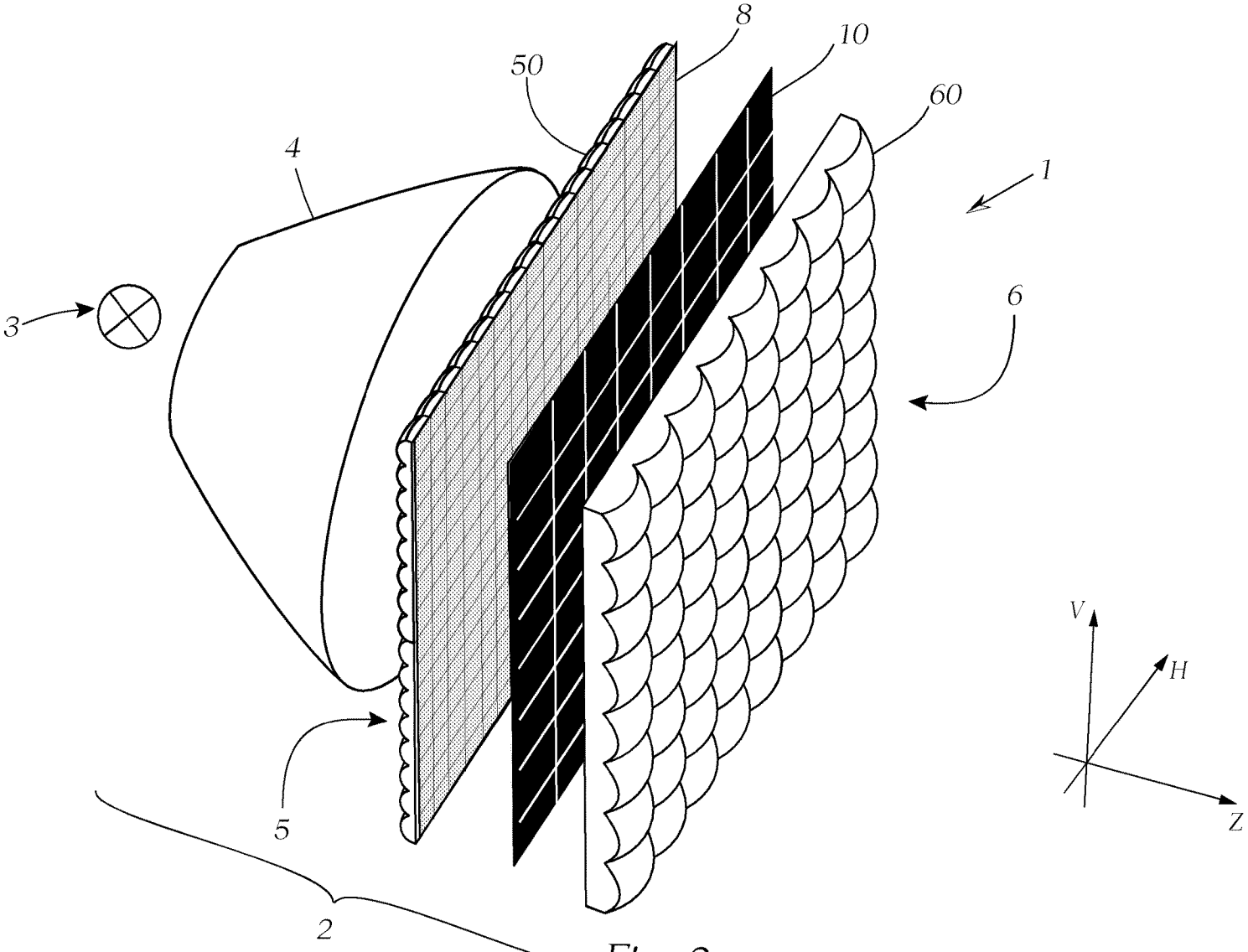
FIG. 2 shows a lighting module with a screen device in an exploded illustration.

FIG. 2 shows the lighting module 1 from FIG. 1, in which the optical imaging system 2 comprises a screen device 10, which is arranged between the incidence optical element 5 and the emergence optical element 6. As is known from the prior art (cf. e.g. AT 514 967 B1 of the applicant), screen devices 10 of this type may prove to be expedient for example when generating dipped-beam distributions. In this case, the cut-off line of a dipped-beam distribution may be created by the forming of screen edges of the screens of the screen device 10 arranged in an intermediate-image plane. The optical imaging system 2 may also comprise further illumination devices (not shown here), which are provided for example for correcting imaging faults, as is described in detail in AT 517 885 A1 of the applicant. For a detailed description of the optical imaging systems with such illumination devices and in particular for a detailed description of the illumination device, the optically effective edges of which are used for forming a dipped-beam distribution and/or for correcting imaging faults, reference is explicitly made to the publications AT 514 967 B1 and AT 517 885 A1.

Figure 3:
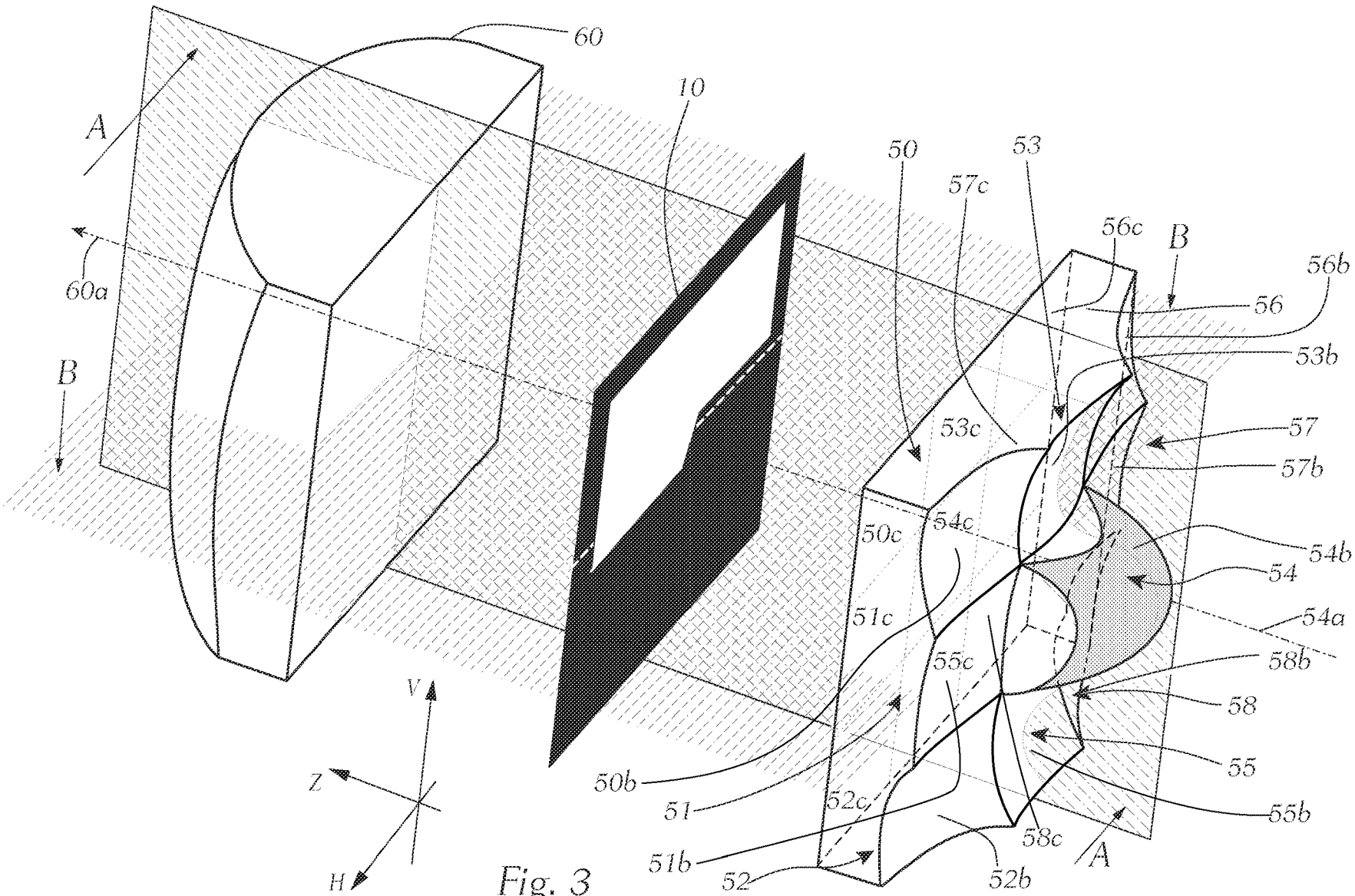
FIG. 3 shows an enlarged cutout of the lighting module from FIG. 2.

FIG. 3 shows an enlarged cutout of the lighting module of FIG. 2. In this case, the incidence optical element 5 has a plurality of micro-incidence optical elements 50 to 58, which are constructed integrally with one another. A first optical axis 50*a* to 58*a* is assigned to each micro-incidence optical element 50 to 58, wherein all first optical axes 50*a* to 58*a* run in the same direction Z, which direction Z corresponds to the propagation direction of the collimated light beams 7 (cf. also FIGS. 5 to 8). The emergence optical element 6 likewise has a plurality of micro-emergence optical elements 60 (FIG. 3 shows one thereof), which are constructed integrally with one another, wherein a second optical axis 60*a* is assigned to each micro-emergence optical element 60 and all second optical axes 60*a* run in the same direction (direction Z in FIG. 3). With regards to assembly, it is advantageous if mutually facing light incidence surfaces of the incidence optical element 5 and the emergence optical element 6 are constructed to be plane. Furthermore, each micro-incidence optical element 50 to 58 has a light incidence surface 50*b* to 58*b*, which faces the collimated light beams 7 and is preferably curved, for example constructed convexly or free-formed, and a preferably plane light emergence surface 50*c* to 58*c*, which faces the emergence optical element 6, wherein all light emergence surfaces 50*c* to 58*c* form a common, preferably plane surface 8—the light emergence surface of the incidence optical element—(cf. also FIGS. 2 and 5). According to the invention, at least two differently constructed micro-incidence optical elements 50 to 58 are assigned to each micro-emergence optical element 60 in such a manner that light beams 9*a* to 9*c* incident onto the at least two differently constructed micro-incidence optical elements 50 to 58 and passing through these at least two differently constructed micro-incidence optical element 50 to 58 (cf. also FIGS. 5 to 8) are incident onto the micro-emergence optical element 60 assigned and/or corresponding to the at least two differently constructed micro-incidence optical elements 50 to 58 (imaging faults may for example be reduced as a result) and form different part regions (e.g. HV region and edges or edge regions) of the light distribution after passing through the micro-emergence optical element 60 (cf. also FIGS. 5 to 8). In the exemplary embodiment shown, a 3×3 micro-incidence-optical-element array is assigned to each micro-emergence optical element (cf. also FIG. 4), wherein a micro-incidence optical element 54 located in a centre of the micro-incidence-optical-element array—a central optical element—is constructed differently from the other micro-incidence optical elements 50 to 53 and 55 to 58 of the micro-incidence-optical-element array. However, this should not be understood to mean that the micro-incidence optical elements 50 to 53 and 55 to 58 of the micro-incidence-optical-element array all have to be constructed in the same way. It is absolutely conceivable that the micro-incidence optical elements 51, 53, 55, 57 form a first group of identical micro-incidence optical elements of the micro-incidence-optical-element array and the micro-incidence optical elements 50, 52, 56, 58 form a second group of identical micro-incidence optical elements of the micro-incidence-optical-element array, wherein the micro-incidence optical elements from the first and from the second group may be constructed differently. An embodiment in which the micro-incidence optical elements of the micro-incidence-optical-element array are constructed in such a manner is often termed a "symmetrical design". Furthermore, it is conceivable that the micro-incidence optical elements belonging to the first or the second group are not all constructed in the same way. Thus, for example, a first part of the first group of micro-incidence optical elements—the micro-incidence optical elements 53 and 55—may be constructed in the same way ("horizontally symmetrical design"), wherein the remaining micro-incidence optical elements of the first group—the micro-incidence optical elements 51 and 57—may form a second part of the first group and be constructed in the same way to one another but differently from the micro-incidence optical elements of the first part of the first group ("vertically symmetrical design"). In this case, it is conceivable that all micro-incidence optical elements of the second group are all constructed differently and for example not one of the micro-incidence optical elements of the first group are the same or congruent. In addition, it is also conceivable that all micro-incidence optical elements of the first and second group are designed individually (are constructed differently). This has the advantage that the number of degrees of freedom during adjustment/setting of a light distribution is increased and enables a better/finer setting of the light distribution to be generated. Generally, the at least two micro-incidence optical elements 50 to 58 may be constructed as an N×M micro-incidence-optical-element array, where N≥2, M≥1 or N≥1, M≥2, wherein all micro-incidence optical elements of the micro-incidence-optical-element array may be constructed differently from one another. It may be expedient in this case that the micro-incidence-optical-element array of the incidence optical element 5 are set up for generating an intermediate image, which is preferably located in front of the emergence optical element 6.

The individual micro-incidence optical elements 50 to 58 of the micro-incidence-optical-element array may be constructed as follows. The central optical element 54 may be constructed as a plano-convex lens and have a collecting action due to a convex course of its light incidence surface 54*b*. This is adjoined by plano-concave lenses or lenspieces 51 to 53 and 55 to 58, which have a scattering action due to a concave course of their light incidence surfaces 51*b* to 53*b* and 55*b* to 58*b*. The plano-concave lenspieces 51, 53, 55, 57 adjoining the central optical element 54 in the horizontal direction H and in the vertical direction V may for example be constructed as halves of a plano-concave lens, which are symmetrical with regards to a plane of symmetry—lens halves—wherein the plane of symmetry divides the plano-concave lens into two preferably identical halves. Expediently, the lens halves are arranged in such a manner that the same have a material thickness which gets ever larger towards the central optical element 54, as a result of which for example, the plano-concave lens or the lenspiece (here—lens half) has a stronger refractive power towards the central optical element 54 (than at its edge and thus at an edge of the micro-incidence-optical-element array) and deflects the collimated light beams 7 more strongly (than at its edge) (cf. also FIGS. 5 to 6). The remaining four micro-incidence optical elements—corner optical elements 50, 52, 56 and 58—of the micro-incidence-optical-element array shown here, which adjoin the central optical element 54, may likewise be constructed as plano-concave lenses or lenspieces. Preferably, the corner optical elements 50, 52, 56 and 58 are constructed as a plano-concave lens, which is rotationally symmetrical about its optical axis, wherein each lens quarter of the rotationally symmetrical plano-concave lens is constructed to be the same as the other three lens quarters. Expediently, the lens quarters in the corners of the micro-incidence-optical-element array are arranged in such a manner that the same have a material thickness which gets ever larger diagonally towards the central optical element 54, as a result of which for example, the plano-concave lens or the lenspiece (here—lens quarter) has a stronger refractive power diagonally towards the central optical element (than at its edge and thus at an edge of the micro-incidence-optical-element array) and deflects the collimated light beams 7 more strongly (than at its edge) (cf. also FIGS. 5 to 6).

Figure 4:
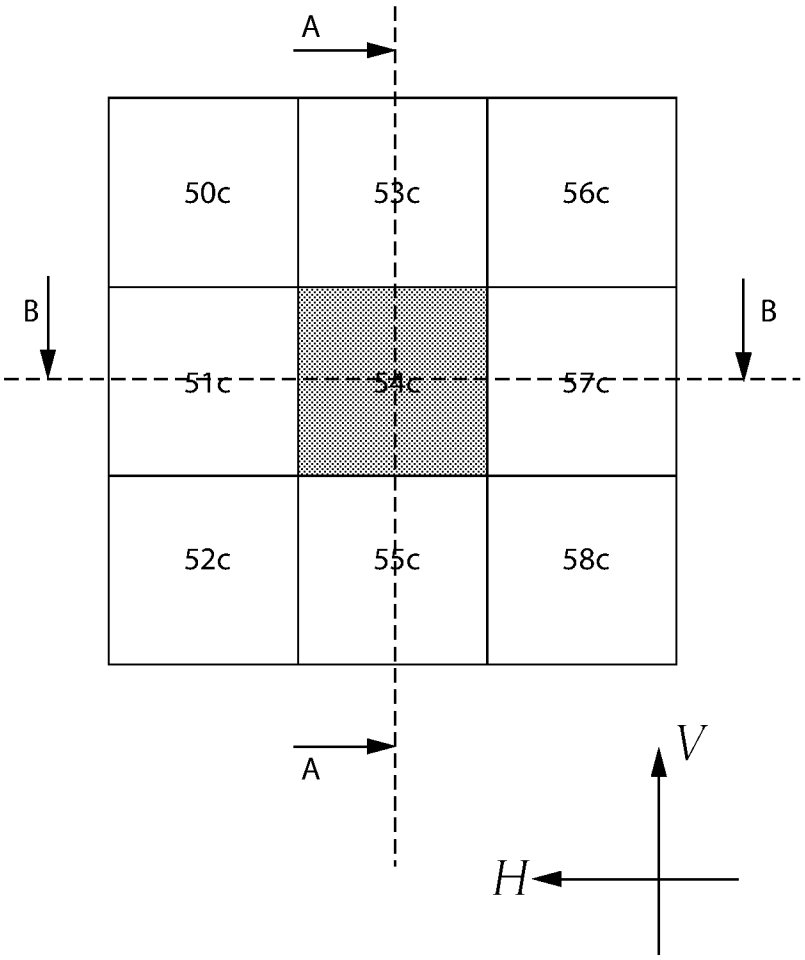
FIG. 4 shows a rear view of the enlarged cutout of FIG. 3.

FIG. 4 shows a schematic front view (view from the front, i.e. counter to the direction Z) of the enlarged cutout of the incidence optical element 5 from FIG. 3. It can be seen for example from FIG. 4 that the central micro-incidence optical element—coloured grey in FIG. 4—and micro-incidence optical elements adjoining the same at least at one point may be arranged in a rectangular pattern, wherein all cells of this rectangular patter may—as shown—be the same size. It is also conceivable that the cells are sized differently. The light emergence surfaces 50*c* to 58*c* of the micro-incidence optical elements can be seen explicitly in FIG. 4. These have a rectangular, even square shape. The shape of the light emergence surfaces 50*c* to 58*c* and the cells may deviate from the square or rectangular shape. However, it may be expedient if the total area of the light emergence surfaces 50*c* to 58*c* of the micro-incidence optical elements 50 to 58 of the micro-incidence-optical-element array are the same size as the light incidence surface 60*b* of the micro-emergence optical element 60 facing the light emergence surfaces 50*c* to 58*c*, to which micro-emergence optical element 60 the micro-incidence optical elements 50 to 58 of the micro-incidence-optical-element array are assigned.

Figure 6:
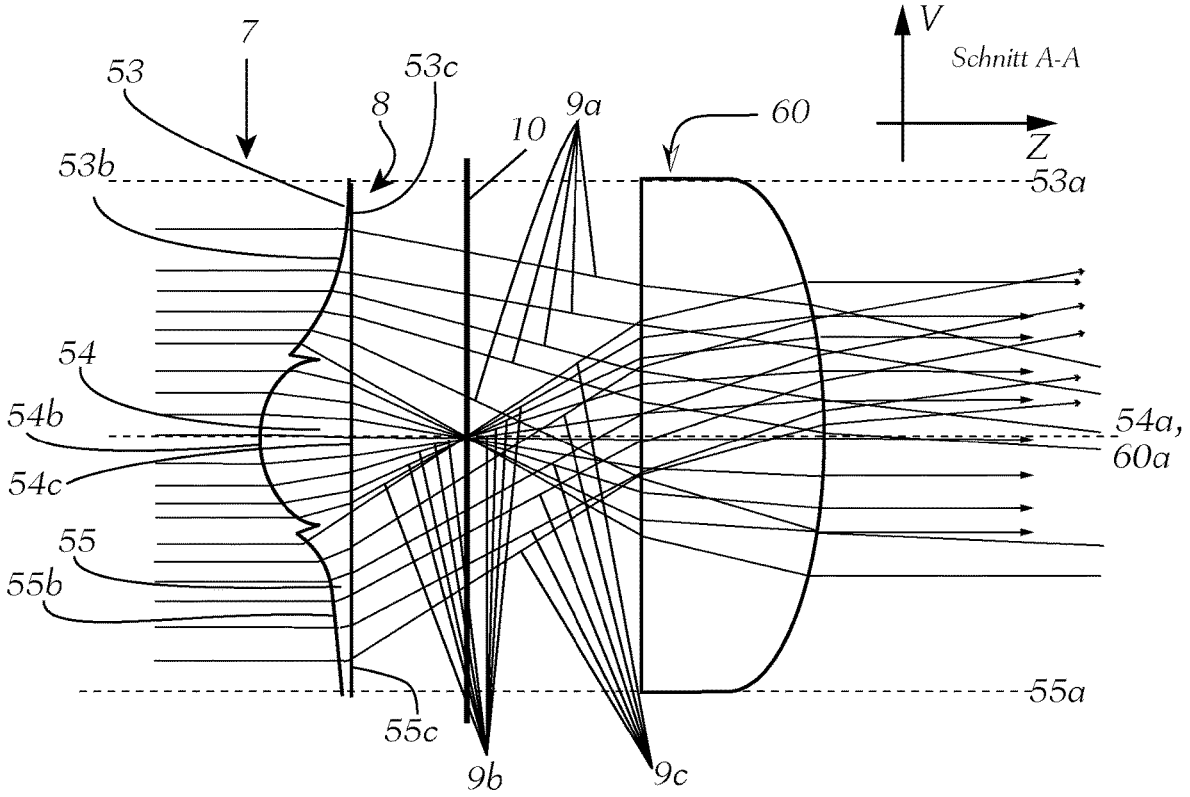
FIG. 6 shows an A-A section of FIG. 3.

Reference is now made to FIGS. 5 to 8, in order to show actual exemplary shapes of the light incidence surfaces of the micro-incidence optical elements and their effect on the beam path of the collimated light beams 7 through the optical imaging system 2. FIG. 6 shows a section A-A of FIG. 3. The collimated light beams 7 are incident onto the micro-incidence optical elements 53 to 55. Each micro-incidence optical element shapes a light bundle 9*a* to 9*c* from the collimated light beams 7 which are incident onto this micro-incidence optical element, which forms an intermediate image. The intermediate image may for example be located in a plane matching the position of the screen device 10. In the preferred embodiment shown, the screen device 10 is arranged in the intermediate-image plane. In the micro-incidence optical elements 51, 53 to 55 and 57 of the micro-incidence-optical-element array shown in FIGS. 5 and 6—FIG. 5 is a section B-B of FIG. 3—the central lens may be constructed as the above-described central lens 54, wherein the lenses 51, 53, 55 and 57 adjoining this central lens 54 may be constructed as above-described plano-concave lenspieces, for example lens halves. As explained previously, the central lens 54 is preferably constructed as a plano-convex lens and collects the light both in the horizontal H and in the vertical direction V. In this case, looking at FIGS. 5 and 6 together, it can be seen that the refractive power of the light incidence surface 54*b* of the central lens 54 in the horizontal direction H does not have to be the refractive power of the light incidence surface 54*b* of the central lens 54 in the vertical direction V. In the horizontal direction H, the light incidence surface 54*b* of the central lens 54 may be more weakly curved and therefore focus less. By means of greater focusing in the vertical direction V (generally—in the vertical plane), a higher illuminance may for example be achieved in a central region—centre—of a generated light distribution. This central region corresponds to the so-called "HV point" in lighting engineering (a point at which the horizontally running HH line or the horizon intersects the vertically running VV line) or "HV region" (a region around the HV point).

Furthermore, it can be seen from FIG. 5, which shows a horizontal section (B-B section) of an enlarged cutout of the lighting module 1 with a screen device 10 of FIG. 3, that the horizontal intersections of the light incidence surfaces 51*b* and 57*b* of the micro-incidence optical elements 51 and 57 adjoining the central lens 54 in the horizontal direction H have curvatures, which differ from the curvatures of the light incidence surfaces 53*b* and 55*b* of the of the micro-incidence optical elements 53 and 55 adjoining the central lens 54 in the vertical direction V. Although FIGS. 5 and 6 show different sections (vertical and horizontal) of a micro-incidence-optical-element array, this applies in general to the present invention: Micro-incidence optical elements which adjoin a central lens of a micro-incidence-optical-element array provided for forming the HV region of a light distribution may all be constructed differently, have different curvatures of the light incidence surfaces, which run in a free-form manner for example, and are provided to form edges (outer edges) of the light distribution.

Furthermore, the central lens 54 may be constructed astigmatically, in order to allow the configuration of a course of a light distribution differently in the horizontal H and vertical direction V for example, as can be seen from the beam paths of FIGS. 5 and 6 (cf. light bundle 9*b* in particular). Conversely, the shape of the central lens 54 resulting from the requirements of the light-distribution course can be determined. With reference to FIG. 6, the micro-incidence optical elements and 55 adjacent to the central lens 54 in the vertical direction preferably substantially deflect the collimated beams 7 incident onto these micro-incidence optical elements 53, 55, without a convergent or divergent light bundle being formed from the same, and therefore essentially have the effect of a prism. These micro-incidence optical elements 53 and 55, which are adjacent in the vertical direction, are responsible for example for generating the edges of a light distribution and may be set up to change a vertical extent of the light distribution and/or the HV region of the light distribution.

The just described assignment of a region of the light distribution (HV region or edge) to a certain micro-incidence optical element cannot always be realized in practice however. Often, it is even advantageous, for example for reasons of homogeneity, if the micro-incidence optical elements 50 to 53 and to 58 of the micro-incidence-optical-element array, which adjoin the central lens 54, have light incidence surfaces 50*b* to 53*b* and 55*b* to 58*b* constructed in such a manner in their region adjacent to the central lens 54 that the collimated light beams 7, which are incident onto these adjacent regions, are refracted to form light beams 9M, which propagate for example in the direction of a region S away from the focal point F of the micro-emergence optical element 60, wherein the region S preferably has a lower distance from the light incidence surface 60*b* of the micro-emergence optical element 60 than the back focal length of the micro-emergence optical element 60, and later, after emergence from the light emergence surface 60*c* of the micro-emergence optical element 60, propagate in a direction lateral to the HV region (of a part region of the light distribution) owing to the defocussing.

A light distribution formed by a micro-optical system comprising at least one micro-incidence-optical-element array and a micro-emergence optical element assigned to the micro-incidence-optical-element array is termed "micro light distribution" in the following.

It may also be advantageous to construct the curvature of the light emergence surface 60*c* in the edge region 60*d* of the micro-emergence optical element 60 in such a free-form manner that the boundary beams 9G of the micro light distribution, that is to say the beams, which upon impingement onto the light emergence surface 60*c* of the micro-emergence optical element 60 are reflected in such a manner by means of total internal reflection TR that they no longer contribute to micro light distribution, only emerge in the case of those collimated light beams 7, which propagate along the optical axes 50*a* to 53*a* and 55*a* to 58*a* without refraction by means of the micro-optical system. As a result, the width of the light distribution is controlled and the luminous-flux efficiency is increased.

In a micro-incidence-optical-element array of the incidence optical element 5, at least one micro-incidence optical element—central lens 54—may therefore be constructed and be assigned to the micro-emergence optical element 60 in such a manner that the collimated light beams 7 incident onto the at least one micro-incidence optical element 54 are shaped to form a corresponding light bundle 9*b*, which propagates in the direction of a HV region of the light distribution after emergence from the micro-emergence optical element 60.

Furthermore, at least one second micro-incidence optical element (in the case of a 3×3 micro-incidence-optical-element array there are eight micro-incidence optical elements 50 to 53 and 55 to 58) are constructed in such a manner and assigned to the micro-emergence optical element 60 in such a manner that the collimated light beams 7 incident onto these at least one second micro-incidence optical elements 50 to 53 and 55 to 58 are formed to form at least one further, preferably to form a plurality of light bundles 9*a* and 9*c*, which light bundle, preferably light bundles, propagates, preferably propagate in the direction outside of a HV region of the light distribution after emergence from the micro-emergence optical element 60, and for example determines, preferably determine, the width of the light distribution.

Figure 7:
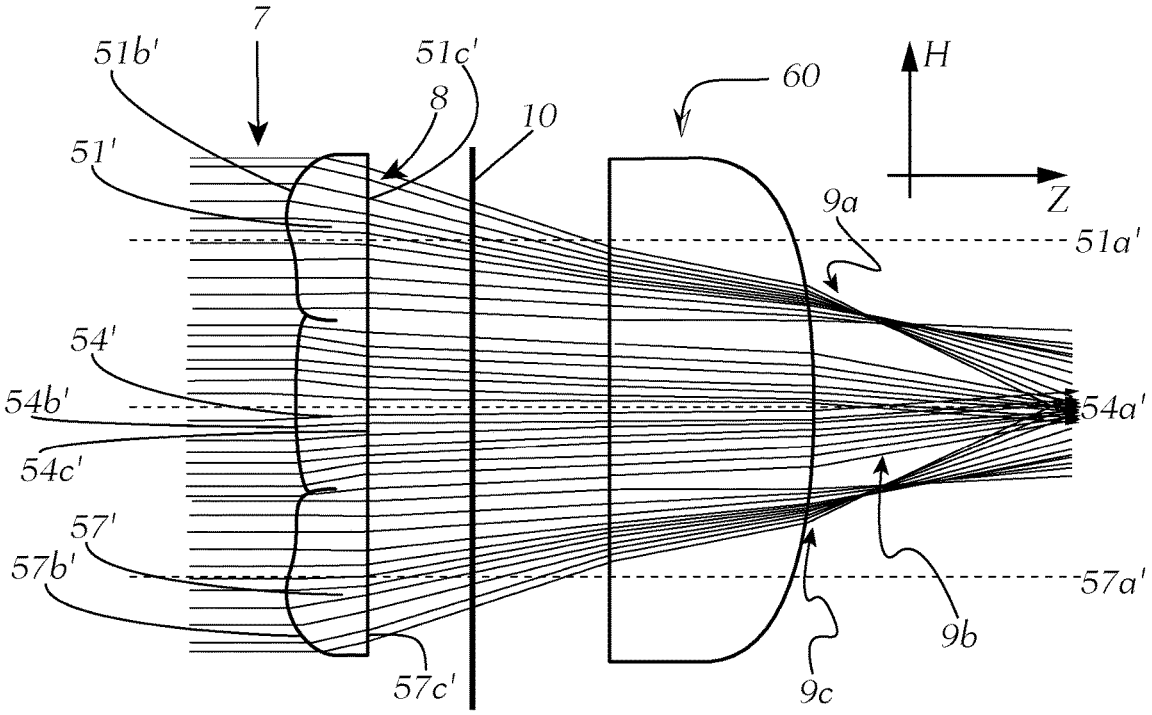
FIG. 7 shows a horizontal section of an enlarged cutout of a further embodiment of a lighting module according to the invention with free-form micro-incidence optical elements.

FIG. 7 shows a horizontal section of an enlarged cutout of a lighting module with an optional screen device 10, which lighting module is essentially the same as the lighting module 1 described in FIGS. 1 to 6. In the cutout of the lighting module illustrated in FIG. 7, the shape of the light incidence surfaces 51*b*', 54*b*', 57*b*' of the micro-incidence optical elements 51', 54', 57' of the incidence optical element is different. Both the central optical element 54' shown here and the micro-incidence optical elements 51' and 57' adjoining this central optical element have light incidence surfaces 51*b*', 54*b*', 57*b*' running in a free-form manner (free-form light incidence surfaces). Seen functionally, the central optical element 54' essentially furthermore forms the HV region and the free-form micro-incidence optical element 51' and 57' adjoining the central optical element 54' form edges or edge regions of a light distribution.

The curvature of a light incidence surface of a single free-form micro-incidence optical element, for example the central optical element 54', may have different values at various points on the light incidence surface, for example the light incidence surface 54*b*' of the central optical element 54'. Different free-form micro-incidence optical elements may have different shapes of curvature of the light incidence surface.

Generally, for example, half of the light incidence surface of a free-form micro-incidence optical element, which corresponds to the upper half when inserting the free-form micro-incidence optical element into the micro-incidence optical element, may for example be differently curved with regards to the other half, in order for example to achieve a different course of the light distribution generated above and below the HH line running through the HV point.

The light emergence surfaces 51*c*', 54*c*' and 57*c*' are part of the common, preferably plane surface 8, which, not only in the FIG. 7 shown, but rather also in the general case, forms an emergence optical element light emergence surface. A use of the free-form lenses is advantageous from the viewpoint of a precise formation/shaping of the light distribution. In this case, the light incidence surfaces 51*b*', 54*b*' and 57*b*' may be adapted/calculated to the requirements for the light distributions to be generated.

FIG. 8 shows a vertical section of an enlarged cutout of a further embodiment of the lighting module according to the invention with an optional illumination device 10. The lighting module is substantially identical to the lighting module 1 described in FIGS. 1 to 6. In the cutout of the lighting module illustrated in FIG. 8, the shape of the light incidence surfaces 53*b*", 55*b*" of the micro-incidence optical elements 53", 55" of the incidence optical element adjoining the central optical element 54 is different. The central optical element 54 shown in FIG. 8 is constructed in a plano-convex manner. The micro-incidence optical elements 53" and 55" adjoining the central optical element 54 are likewise constructed in a plano-convex manner. In this case, the micro-incidence optical elements 53", 55" surrounding the central optical element 54 are constructed in such a manner that their light incidence surfaces 53*b*", 55*b*" lie in a common surface 500. This may apply both for all micro-incidence optical elements adjacent to the central optical element and for individual pairs of the micro-incidence optical elements adjacent to the central optical element, although different pairs may have differently constructed common surfaces. The light incidence surfaces 53*b*", 55*b*" of the micro-incidence optical elements 53", 55" adjoining the central optical element 54 are preferably set up to refract the collimated light beams 7 incident onto them in such a manner that the same are formed, after emergence from the micro-emergence optical element 60 of the lighting module, in a region 501, but nonetheless in edges or edge regions of a, preferably lawful, light distribution, for example at a distance of approx. 25 metres in front of the lighting module. The micro-incidence optical elements 53", 55" adjoining the central optical element 54 may furthermore be constructed as plano-convex lenspieces. FIG. 8 shows one such embodiment, wherein the plano-convex lenspieces additionally have mutually coincident optical axes, which additionally coincide with the optical axis 54*a* of the central optical element. It is conceivable that the central optical element 54 illustrated in FIG. 8 and the micro-incidence-optical-element array comprising the micro-incidence optical elements 53" and 55" adjoining the central optical element 54 is constructed rotationally symmetrically with regards to the optical axis 54*a* and therefore differs from the square form of the micro-incidence-optical-element array in FIG. 4, for example.

As already mentioned, all figures show micro-incidence optical elements, the light emergence surfaces of which preferably form a common, preferably plane surface 8. In this case, it is to be noted that from a lighting-engineering optical viewpoint, biconvex/convexo-concave or other combinations with for example concavely curved light incidence surfaces, can be used in order to take account of a strongly dispersing incidence optical element.

The production process can be simplified by using plane light emergence surfaces. Furthermore, it is conceivable that the micro-emergence optical element and the at least two micro-incidence optical elements assigned to it are joined to form a common stack and connected by means of a transparent adhesive and in this manner, form a common component, wherein at least one screen (a part of the at least one above-mentioned illumination device 10) can be provided between the micro-emergence optical element and the at least two micro-incidence optical elements assigned to it. Furthermore, in the case of surfaces constructed to be plane, tilting of the micro-incidence optical elements in relation to one another may be reduced and in this manner for example, alignment of the optical axes can be achieved, if the micro-incidence optical elements are connected as described above, for example bonded, to the micro-emergence optical element.

Insofar as it does not necessarily result from the description of one of the above-mentioned embodiments, it is assumed that the described embodiments can be combined with one another as desired. Among other things, this means that the technical features of an embodiment with the technical features of a different embodiment can be combined individually and independently as desired, in order to achieve a further embodiment of the same invention in this manner.

The invention claimed is:

1. A motor-vehicle illumination device (1) for generating a light distribution, comprising:

an optical imaging system (2); and at least one light source (3) assigned to the optical imaging system, wherein the optical imaging system (2) comprises a collimator (4), an incidence optical element (5) and an emergence optical element (6), wherein the collimator (4) is arranged between the at least one light source (3) and the incidence optical element (5) and is configured to collimate light beams generated by the at least one light source (3) and to direct the collimated light beams (7) onto the incidence optical element (5) of the optical imaging system (2), wherein the incidence optical element (5) has a plurality of micro-incidence optical elements (50 to 58) constructed integrally with one another, wherein a first optical axis (50*a* to 58*a*) is assigned to each micro-incidence optical element (50 to 58), wherein all first optical axes (50*a* to 58*a*) run in the same direction, which direction corresponds to the propagation direction of the collimated light beams (7), wherein the emergence optical element (6) has a plurality of micro-emergence optical elements (60) constructed integrally with one another, wherein a second optical axis (60*a*) is assigned to each micro-emergence optical element (60), wherein all second optical axes (60*a*) run in the same direction, wherein each micro-incidence optical element (50 to 58) has a light incidence surface (50*b* to 58*b*) facing the collimated light beams and a light emergence surface (50*c* to 58*c*) facing the emergence optical element (6), wherein all light emergence surfaces (50*c* to 58*c*) form a common surface (8), wherein at least two differently constructed micro-incidence optical elements (50 to 58) are assigned to each micro-emergence optical element (60) in such a manner that light beams (9*a* to 9*c*) incident onto the at least two differently constructed micro-incidence optical elements (50 to 58) and passing through these at least two differently constructed micro-incidence optical elements (50 to 58) are incident exclusively onto the micro-emergence optical element (60) assigned to the at least two differently constructed micro-incidence optical elements (50 to 58) and form different part regions of the light distribution after passage through the micro-emergence optical element (60), wherein at least one first micro-incidence optical element (54) of the at least two differently constructed micro-incidence optical elements (50 to 58) assigned and/or corresponding to the micro-emergence optical element (60) is constructed in such a manner and corresponds and/or is assigned to the micro-emergence optical element (60) in such a manner that collimated light beams (7) incident onto this at least one first micro-incidence optical element (54) propagate in the direction of an HV region of the light distribution after emergence from the micro-emergence optical element (60), and wherein at least one second micro-incidence optical element (50 to 53, 55 to 58) of the at least two differently constructed micro-incidence optical elements assigned and/or corresponding to the micro-emergence optical element (60) is constructed in such a manner and corresponds and/or is assigned to the micro-emergence optical element (60) in such a manner that collimated light beams (7) incident onto this at least one second micro-incidence optical element (50 to 53, 55 to 58) propagate in the direction outside of an HV region of the light distribution after emergence from the micro-emergence optical element (60).

2. The motor-vehicle illumination device according to claim 1, wherein the at least two micro-incidence optical elements (50 to 58) are arranged in an N×M micro-incidence-optical-element array, where N≥2 or M≥2.

3. The motor-vehicle illumination device according to claim 1, wherein the incidence optical element (5) is configured to generate an intermediate image, which intermediate image is imaged by the emergence optical element (6) in front of the motor-vehicle illumination device (1).

4. The motor-vehicle illumination device according to claim 3, wherein the intermediate image is located in front of the emergence optical element (6).

5. The motor-vehicle illumination device according to claim 1, wherein at least one first micro-incidence optical element (54) is constructed as a plano-convex lens.

6. The motor-vehicle illumination device according to claim 2, wherein the at least two micro-incidence optical elements (50 to 58) are arranged in a 3×3 micro-incidence-optical-element array.

7. The motor-vehicle illumination device according to claim 1, wherein the at least one second micro-incidence optical element (50 to 53, 55 to 58) is constructed as a plano-concave lens or as a plano-concave lenspiece or as a plano-convex lenspiece.

8. The motor-vehicle illumination device according to claim 1, wherein the light incidence surfaces (50*b* to 58*b*) are constructed as free-form surfaces.

9. A motor-vehicle headlamp having at least one motor-vehicle illumination device according to claim 1.

10. A motor-vehicle headlamp, which is constructed as a motor-vehicle illumination device according to claim 1.

11. A motor vehicle having at least one motor-vehicle headlamp according to claim 9.

* * * * *